US007900781B2

(12) United States Patent
Baine et al.

(10) Patent No.: US 7,900,781 B2
(45) Date of Patent: Mar. 8, 2011

(54) STORAGE SYSTEM

(75) Inventors: Tim Baine, Bonner Springs, KS (US); Michael Gregory, Huntersville, NC (US); Lance Rake, Lawrence, KS (US); David Starr, Naperville, IL (US); Robert J. Warner, Jr., Charlotte, NC (US); Joseph J. Yankello, Cornelius, NC (US)

(73) Assignee: Rubbermaid Incorporated, Huntersville, NC (US)

( * ) Notice: Subject to any disclaimer, the term of this patent is extended or adjusted under 35 U.S.C. 154(b) by 237 days.

(21) Appl. No.: 12/178,400

(22) Filed: Jul. 23, 2008

(65) Prior Publication Data

US 2009/0166307 A1 Jul. 2, 2009

Related U.S. Application Data

(60) Provisional application No. 60/962,114, filed on Jul. 26, 2007.

(51) Int. Cl.
*A47F 5/08* (2006.01)

(52) U.S. Cl. ..... 211/59.1; 211/94.01; 211/106.01

(58) Field of Classification Search ..... 211/183, 211/94.01, 106.01, 57.1, 87.01, 162, 59.1; 248/303, 304, 307
See application file for complete search history.

(56) References Cited

U.S. PATENT DOCUMENTS

| | | | | |
|---|---|---|---|---|
| 458,590 | A * | 9/1891 | Matthies | 40/322 |
| 901,901 | A * | 10/1908 | Hornich, Jr. | 402/72 |
| 4,658,967 | A * | 4/1987 | Wang | 211/94.01 |
| 5,392,934 | A * | 2/1995 | Fox | 211/94.01 |
| 5,944,294 | A * | 8/1999 | Baer | 248/220.43 |
| 6,758,355 | B2 * | 7/2004 | Zidek | 211/205 |
| 6,971,614 | B2 * | 12/2005 | Fischer et al. | 248/220.43 |
| 7,074,998 | B2 * | 7/2006 | Hurwicz | 84/454 |
| 7,448,582 | B2 * | 11/2008 | Jackson | 248/215 |
| 7,686,172 | B2 * | 3/2010 | Wisnoski et al. | 211/94.01 |
| 7,694,925 | B2 * | 4/2010 | Kokenge et al. | 248/220.42 |
| 2007/0102604 | A1 * | 5/2007 | Nawrocki | 248/220.31 |

OTHER PUBLICATIONS

Closetmaid; http://www.closetmaid.com/Look/GP2/maxload_index.cfm: 2 pages.

* cited by examiner

*Primary Examiner* — Korie Chan
(74) *Attorney, Agent, or Firm* — Dennis J. Williamson; Moore & Van Allen, PLLC

(57) ABSTRACT

A storage system comprises a rail having a protrusion including a first flange and a second flange. An accessory mount for mounting to the rail includes a top hook for engaging the first flange and a resilient bottom hook for engaging the second flange. The rail comprises a back rail portion comprising a substantially planar member and a front rail portion substantially coextensive with the back rail portion and secured to the back rail portion. The protrusion may be symmetrical about the longitudinal axis. The first flange and the second flange define first and second recesses. A method of assembling a support is also provided where a first hook is inserted the first flange and a second hook deforms to engage the second flange.

9 Claims, 4 Drawing Sheets

STORAGE SYSTEM

This application claims benefit of priority under 35 U.S.C. §119(e) to the filing date of to U.S. Provisional Application No. 60/962,114, as filed on Jul. 26, 2007, which is incorporated herein by reference in its entirety.

The invention relates to storage systems and more particularly to wall mounted storage systems.

BACKGROUND

Such wall mounted storage systems are sold by Newell Rubbermaid Inc. under the trademarks FASTTRACK and 300X. These systems comprise a rail or a plurality of rails that are mounted to a substantially vertical supporting surface such as a wall. The rail supports a variety of organizing and storage accessories such as hooks, shelving units and tool holders. The accessories can be removed from and attached to the rail along its length such that the system provides a flexible, reconfigurable storage and organizing system.

SUMMARY OF THE INVENTION

A storage system is provided comprising a rail having a protrusion including a first flange and a second flange. An accessory mount for mounting to the rail includes a top hook for engaging the first flange and a resilient bottom hook for engaging the second flange.

A rail is also provided for supporting an accessory mount comprising a back rail portion comprising a substantially planar member and a front rail portion substantially coextensive with the back rail portion and secured to the back rail portion. A protrusion is formed on the front rail portion and extends along a longitudinal axis of the rail. The protrusion comprises a first flange and a second flange extending along the longitudinal axis where the protrusion is symmetrical about the longitudinal axis. The first flange and the second flange are formed with rounded outer peripheries and define a first recess located behind and extending along the first flange and a second recess located behind and extending along the second flange.

A method of assembling a support is also provided comprising providing a rail having a protrusion comprising a first flange and a second flange where the protrusion extends for substantially the length of the rail. The first flange defines a first recess and said second flange defines a second recess. The rail is mounted to a surface. An accessory mount is provided having a first hook and a second hook. The first hook is inserted on the first flange such that the first hook extends into the first recess. The bottom of the accessory mount is pushed towards the rail forcing the second hook into engagement with the second flange to deform the second hook. The second hook passes transversely under the second flange and snaps back toward its original shape to engage the second flange.

DESCRIPTION OF EMBODIMENTS OF THE INVENTION

Figure 1:
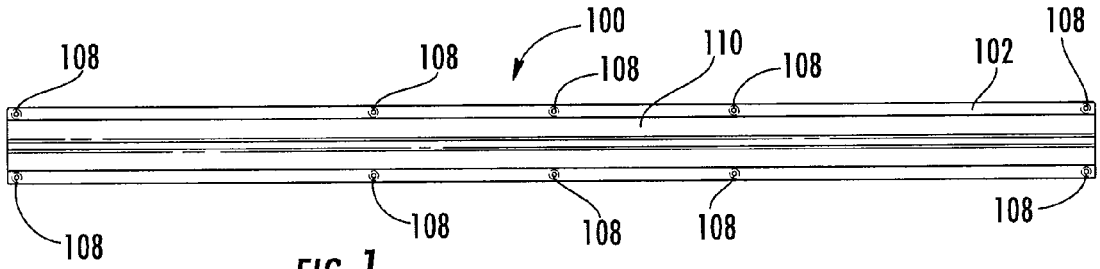
FIG. 1 is plan view showing a rail for use in the storage system.
Figure 2:
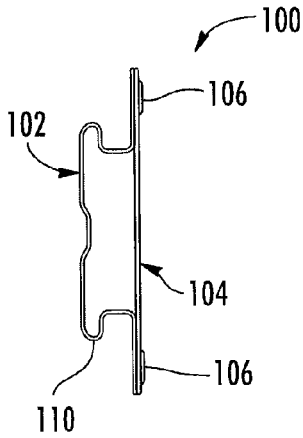
FIG. 2 is a side view showing the rail of FIG. 1.
Figure 3:
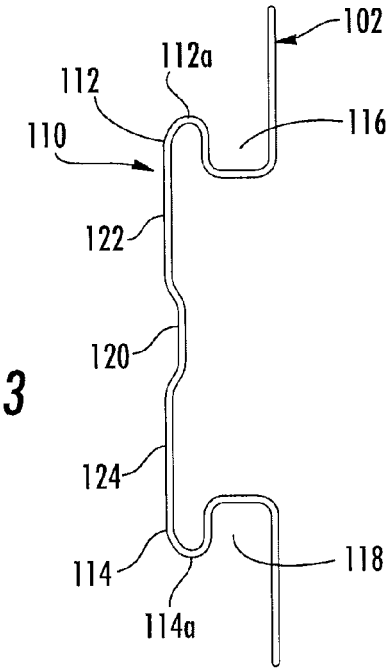
FIG. 3 is a side view showing the front rail portion of the rail of FIG. 1.
Figure 4:
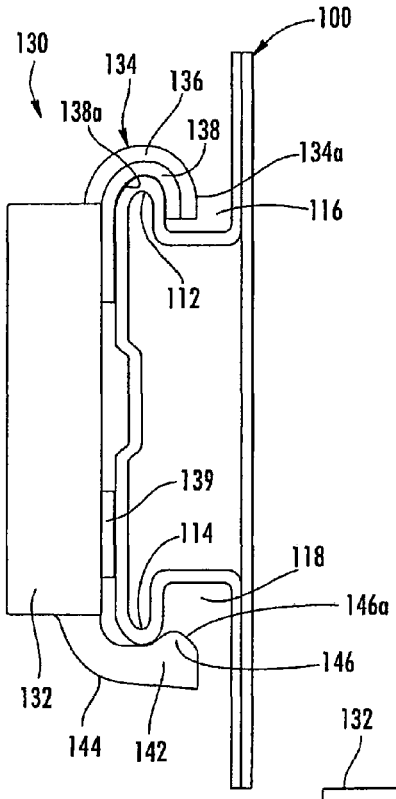
FIG. 4 is a side view of an accessory for mounting on the rail of FIG. 1.
Figure 5:
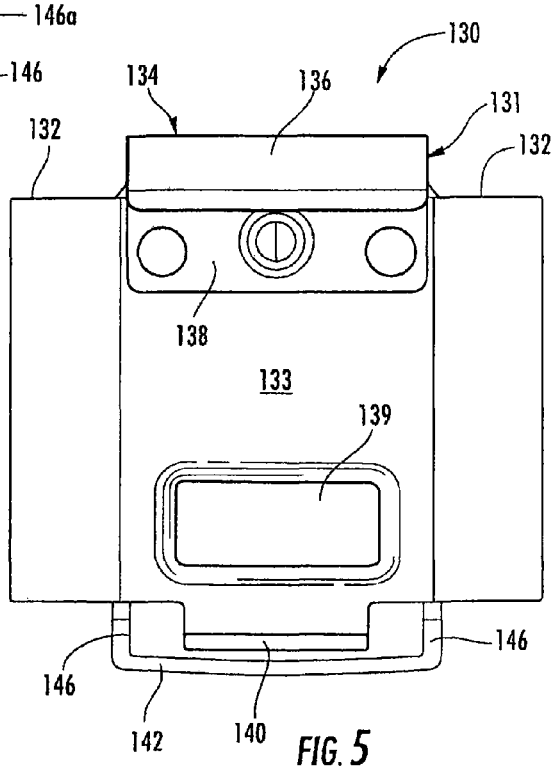
FIG. 5 is a back view of the accessory of FIG. 4.
Figure 7:
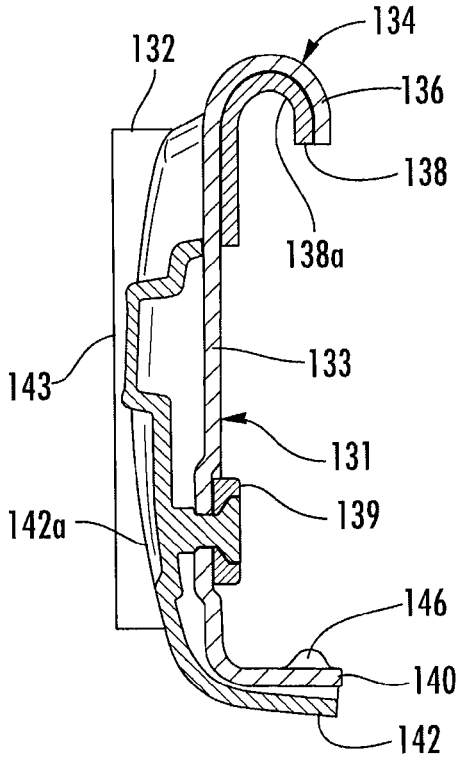
FIG. 7 is a section view taken along line 7-7 of FIG. 6.
Figure 8:
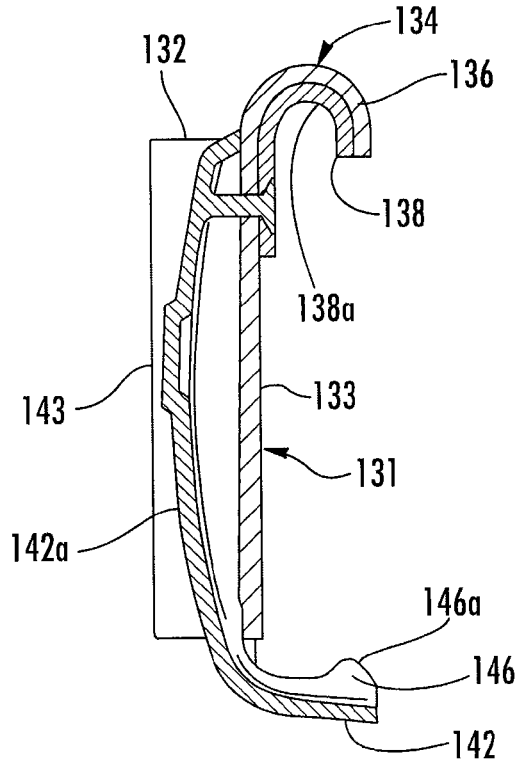
FIG. 8 is a section view taken along line 8-8 of FIG. 6.
Figure 6:
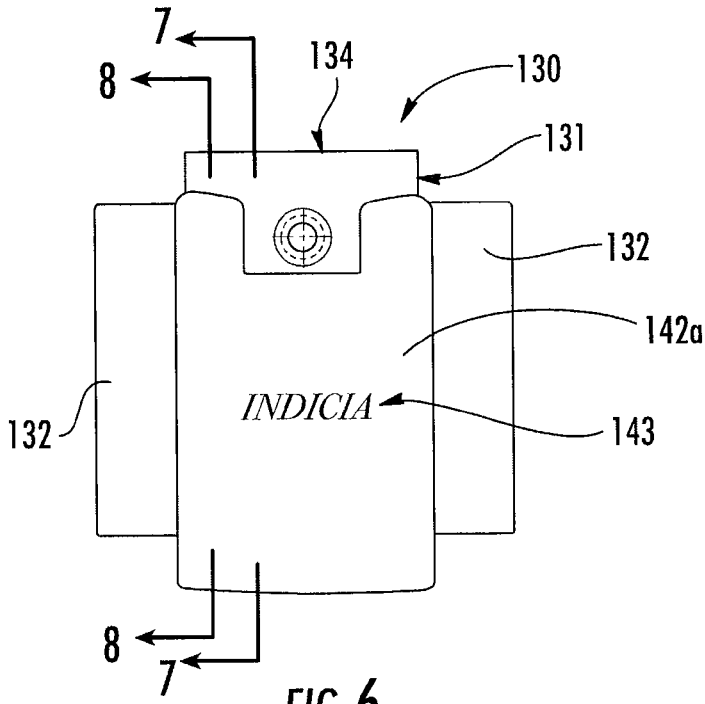
FIG. 6 is a front view of the accessory of FIG. 4.

A rail for use in a wall mounted storage system is shown generally at 100 in the Figures. The rail 100 is constructed of two components—a front rail portion 102 and a back rail portion 104. The back rail 104 portion comprises a substantially planar member constructed of full hard steel or other structurally rigid material. The back rail portion 104 is dimensioned so as to extend for substantially the length and width of the finished rail 100. While the rail may be dimensioned to in a variety of sizes in one embodiment the rail has a horizontal length that is substantially greater than the vertical height. For example, the rail may have a height of approximately 2 to 3 inches and a length of approximately 4 to 6 feet. A plurality of mounting apertures 106 are provided along the length of the back rail portion 104.

The front rail portion 102 may also comprise full hard steel formed to have the shape shown in the drawings. The finished dimensions of the front rail portion 102 substantially conform to the dimensions of the back rail portion 104 such that the front rail portion 102 is substantially coextensive with the back rail portion 104. While in the illustrated embodiment the front rail portion 102 is coextensive with the back rail portion 104, these components do not necessarily have to be coextensive. A plurality of mounting apertures 108 are provided along the length of the front rail portion 102 that are aligned with the apertures 106 on the back rail portion 104 when the front rail portion is secured to the back rail portion. The apertures may also be formed in the rail after the front and back rail portions are joined together. The apertures receive fasteners for securing the rail to the wall or other vertical surface. In one embodiment the front rail portion 102 is secured to the back rail portion 104 by welding. Other mechanisms may also be used to secure the front rail portion 102 to the back rail portion 104 such as rivets or other fasteners, adhesive, a mechanical joint such as crimping or the like.

The front rail portion 102 has a protrusion 110 formed therein that in one embodiment extends for the length of the rail. When joined together the front rail portion 102 and the back rail portion form a rail 100 that has a box section that is very rigid and resists twisting and bending. The protrusion 110 is configured to mate with accessories that are to be mounted on rail 100 as will hereinafter be described. In one embodiment the protrusion 110 is substantially symmetrically disposed on front rail portion 102 such that the rail 100 may be properly secured to the wall or other vertical surface with either longitudinal side on the top. Making the rail symmetrical also facilitates its use as a ceiling mounted support because accessories can grip both protrusions 112 and 114. The protrusion 110 has a first upwardly facing flange 112 and a second downwardly facing flange 114 where both flanges extend for the length of the front rail portion 102. The flanges 112 and 114 create longitudinally extending recesses 116 and 118, respectively, that extend for the length of the front rail portion 102. Because the rail is symmetrical it can be mounted on a vertical surface with either flange 112 or 114 facing upward. In explaining operation of the rail, reference is made to an upper flange and a lower flange. It is to be understood that either flange 112 or flange 114 may function as the upper or lower flange depending on the orientation of rail 100.

The flanges 112 and 114 are formed with rounded outer peripheries 112*a* and 114*a* that facilitate the mounting and removal of accessories on the rail. The center portion of protrusion 110 has a longitudinally extending recess 120 formed therein that is used to reinforce the rail along its length. A pair of flat surfaces 122 and 124 are formed between the recess 120 and flanges 112 and 114, respectively.

An accessory mount 130 for mounting to the rail 100 is shown in FIGS. 4 through 11. The accessory mount 130 is intended to support any accessory 127 that may be mounted to the rail including, but not limited to, hooks, shelves, cabinets, tool holders, equipment holders, tools, power strips or the like. The accessory mount includes support portions 132 that support the specific accessory. For example, support portions 132 may have a hook, shelf support, cabinet, tool holder, equipment holder, tool, power strip or the like connected thereto such as by welding. The accessory may also be removably connected to the support portions 132. Further, the accessory and the support portions 132 may be integrally formed with one another such that the transition from the support portion to the accessory is seamless.

Figure 9:
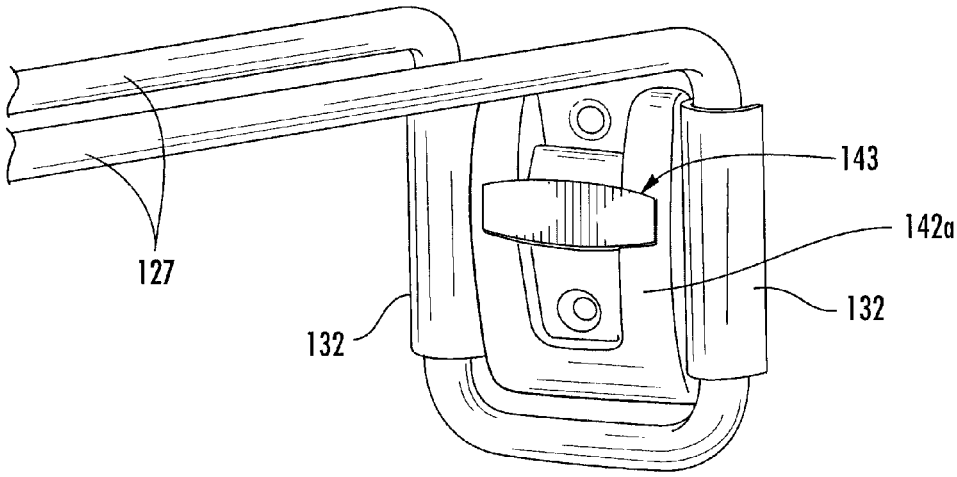
FIG. 9 is a perspective front view of the accessory of FIG. 4.
Figure 10:
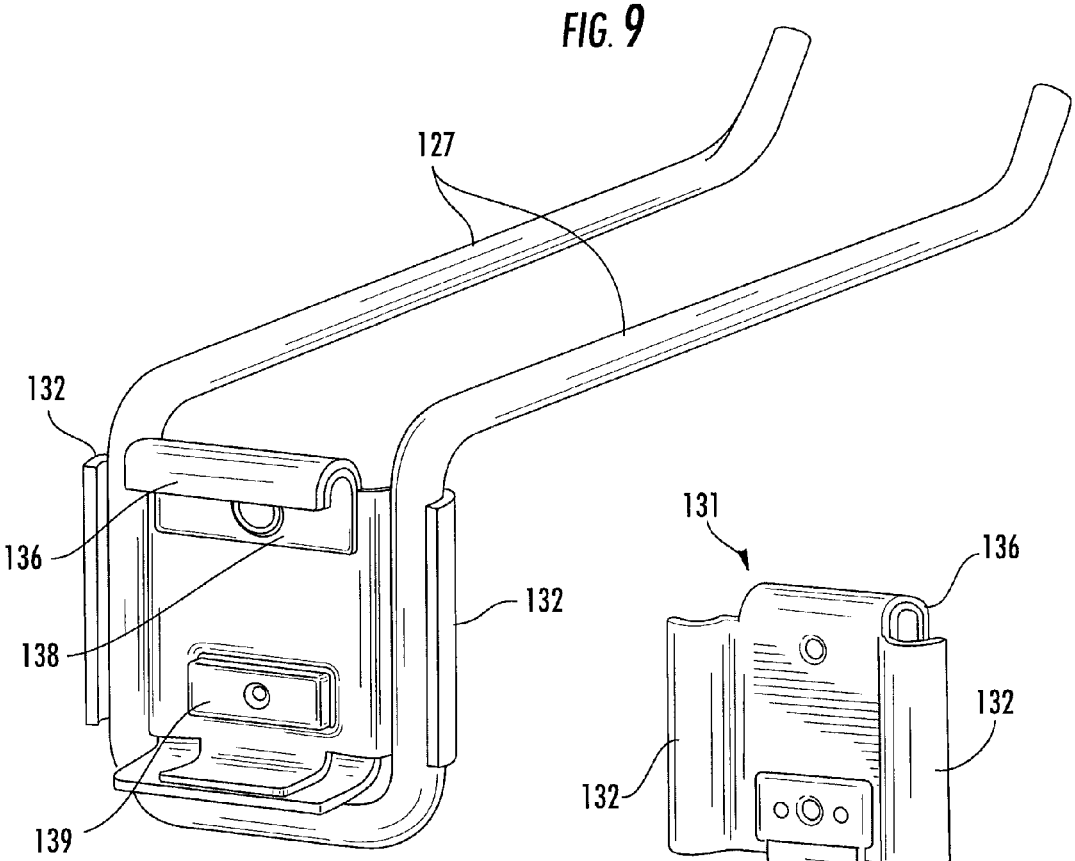
FIG. 10 is a perspective back view of the accessory of FIG. 4.
Figure 11:
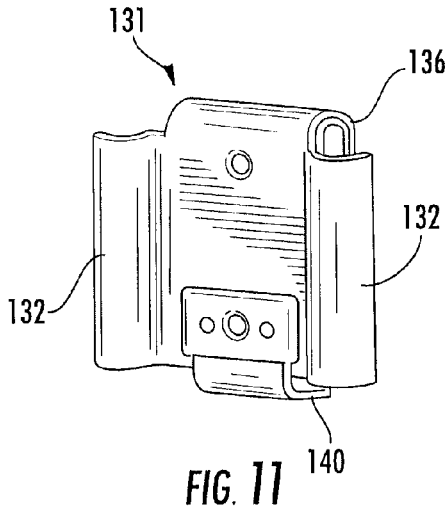
FIG. 11 is a perspective front view of a component of the accessory of FIG. 4.

The support portions 132 are connected to a top hook support 131 that may be made of sheet metal or other rigid material. Top hook support 131 includes a body portion 133 that terminates at its top end in a first hook 134 that is open in a downward direction. Hook 134 has an inner shape that closely corresponds to the outer peripheries 112*a* and 114*a* of flanges 112 and 114, respectively. Further, the lip 134*a* of hook 134 has a length sufficient to extend into recesses 116 or 118 for a major portion of the depth of the recesses as shown in FIG. 9. Hook 134 has a thickness and width sufficient to support the weight of the accessory and any articles intended to be supported by the accessory. The hook 134 may comprise an outer portion 136 made of a substantially rigid material such as sheet metal. In one embodiment outer portion 136 is formed integrally with body portion 133. Hook 134 may also comprise an inner sleeve 138 made of a more resilient material such as plastic or rubber. The inner sleeve 138 may be connected to the outer portion 136 such as by sonic welding, fasteners or other connection mechanism. The exposed surface 138*a* of the inner sleeve 138 is shaped and dimensioned to closely receive outer peripheries 112*a* and 114*a* of flanges 112 and 114. The inner sleeve 138 ensures a tight fit with the rail 100 and prevents marring or scraping of the rail surface. Another pad 139 may also be attached to the body portion 133 so as to contact the front of the rail when the accessory is mounted on the rail. The pad 139 may be made of plastic or rubber sonically welded or otherwise secured to hook support 131 and also prevents marring or scraping of the rail surface.

A flange 140 extends from hook support 131 near the bottom of body portion 133. Flange 140 fits under the lower flange but does not extend into the recess formed by the lower flange. In one embodiment the flange 140 is formed of the same material as the body portion 133 and may be formed integrally therewith.

A resilient bottom hook 142 is mounted on the hook support 131 for engaging the lower flange in a snap fit connection. Bottom hook 142 extends generally transverse to flanges 112 and 114 when the accessory is mounted on rail 100. Bottom hook 142 is formed with protrusions 146 at either end thereof where the protrusions extend into recesses 116 or 118 a minor portion of the depth of the recesses. Protrusions 146 have a rounded outer surface 146*a* to facilitate the mounting of the accessory on rail 100. Because the member 144 is relatively thin and made of a resilient material such as plastic, the hook 142 can flex relative to the hook support 131 to allow the accessory to be removably mounted to the rail 100. In the illustrated embodiment, bottom hook 142 includes a portion 142*a* (FIGS. 6, 7 and 8) that is connected to the front of hook support 131 and forms a decorative fascia on the front of the support. Portion 142*a* may be molded to include designs, logos, words, symbols or other indicia 143.

To mount an accessory on the rail 100, the top hook 134 is inserted on flange 112 or 114 such that the hook extends into the top recess 116 or 118. The bottom of the accessory mount 130 is pushed towards the rail 100 forcing bottom hook 142 into engagement with the bottom flange 112 or 114. The bottom flange 112 or 114 engages surfaces 146*a* to slightly deform the bottom hook 142 and push the bottom hook 142 away from the top hook 134. The bottom hook 142 deforms until it can pass transversely under the bottom flange 112 or 114. The bottom hook 142 then snaps back to its original shape forcing protrusions 146 into recess 116 or 118 and locking the accessory mount 130 on the rail 100.

To remove the accessory mount 130 from rail 100 the process is reversed. A force is applied to the bottom of the accessory mount 130 pulling the accessory mount away from the rail 100. The protrusions 146*a* engage the bottom flanges causing the bottom hook 142 to deform and spread away from top hook 134. The rail can then be removed from between the top hook 134 and the bottom hook 142. The accessory mount and its associated accessory can be positioned and repositioned any where along the rail 100.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A storage system comprising:

a rail having a back that is adapted to be secured against a vertical surface and a front;

said rail having a protrusion comprising a first flange and a second flange;

an accessory mount for mounting to the rail including a rigid steel hook support comprising a top hook having an inner shape that closely corresponds to the first flange for engaging the first flange and a body portion that extends over the front of the rail;

a resilient plastic bottom hook mounted on the hook support and including a protrusion for engaging the second flange.

2. The storage system of claim 1 wherein said protrusion that extends for substantially the length of the rail.

3. The storage system of claim 1 wherein said first flange defines a recess between the first flange and the back such that said top hook extends into said recess.

4. The storage system of claim 1 further including a resilient sleeve in said top hook.

5. The storage system of claim 1 wherein said bottom hook includes a portion that extends to a front of said hook support opposite to said rail.

6. The storage system of claim 5 wherein said portion is a decorative fascia.

7. The storage system of claim 6 wherein indicia is formed on said portion.

8. The storage system of claim 1 wherein a third flange extends from said hook support that fits under the second flange.

9. A method of assembling a support comprising:

providing a rail having a protrusion comprising a first flange and a second flange, said protrusion extending for substantially the length of the rail and wherein said first flange defines a first recess and said second flange defines a second recess; mounting the rail to a surface;

providing an accessory mount having a rigid steel hook support comprising a first hook having an inner shape that closely corresponds to the first flange for engaging the first flange and a body portion that extends over the front of the rail, and a resilient plastic second hook mounted on the hook support and including a protrusion for engaging the second flange;

inserting said first hook on said first flange such that said first hook extends into the first recess;

pushing the bottom of the accessory mount towards the rail forcing the second hook into engagement with the second flange to deform the second hook and passing the second hook transversely under the second flange such that said protrusion engages said second recess;

and allowing the second hook to snap back toward its original shape to engage the second flange.

* * * * *